US011981972B2

(12) United States Patent
Gao et al.

(10) Patent No.: US 11,981,972 B2
(45) Date of Patent: May 14, 2024

(54) SOFTENING METHOD FOR HIGH-STRENGTH Q AND P STEEL HOT ROLL

(71) Applicants: BAOSTEEL ZHANJIANG IRON & STEEL CO., LTD, Guangdong (CN); BAOSHAN IRON & STEEL CO., LTD., Shanghai (CN)

(72) Inventors: Xingjian Gao, Guangdong (CN); Jiachun Xu, Guangdong (CN); Ye Wang, Guangdong (CN)

(73) Assignees: BAOSTEEL ZHANJIAN IRON & STEEL CO., LTD., Guangdong (CN); BAOSHAN IRON & STEEL CO., LTD., Shanghai (CN)

( * ) Notice: Subject to any disclaimer, the term of this patent is extended or adjusted under 35 U.S.C. 154(b) by 651 days.

(21) Appl. No.: 16/648,781

(22) PCT Filed: Sep. 20, 2018

(86) PCT No.: PCT/CN2018/106703
§ 371 (c)(1),
(2) Date: Mar. 19, 2020

(87) PCT Pub. No.: WO2019/057114
PCT Pub. Date: Mar. 28, 2019

(65) Prior Publication Data

US 2020/0270714 A1 Aug. 27, 2020

(30) Foreign Application Priority Data

Sep. 20, 2017 (CN) ..... 201710853613.3
Jun. 19, 2018 (CN) ..... 201810631922.0

(51) Int. Cl.
*C21D 8/00* (2006.01)
*C21D 9/02* (2006.01)

(52) U.S. Cl.
CPC ..... *C21D 9/02* (2013.01); *C21D 8/00* (2013.01)

(58) Field of Classification Search
CPC ... C21D 9/02; C21D 8/00; C21D 1/22; C21D 8/0226; C21D 8/0263; C21D 9/0025; C21D 1/84; C21D 9/52; B21B 1/26; F27B 11/00
See application file for complete search history.

(56) References Cited

U.S. PATENT DOCUMENTS

2011/0146852 A1 6/2011 Matsuda et al.
2014/0193667 A1* 7/2014 Shuto ..... C22C 38/10 148/504
2014/0373981 A1* 12/2014 Wang ..... C22C 38/42 148/541

FOREIGN PATENT DOCUMENTS

CN 102149840 A 8/2011
CN 102226248 10/2011
(Continued)

OTHER PUBLICATIONS

Office Action dated Feb. 28, 2022 from Korean Patent Office for 10-2020-7010903.
(Continued)

*Primary Examiner* — Rebecca Janssen
(74) *Attorney, Agent, or Firm* — Lei Fang, Esq.; Smith Tempel Blaha LLC

(57) ABSTRACT

There is disclosed a softening method for a high-strength Q & P steel hot-rolled coil, comprising: after heating a Q & P steel ingot, subjecting it to rough rolling, finish rolling, laminar cooling and coiling to obtain a hot-rolled coil; after unloading the coil, covering the coil on-line with an insulating enclosure and moving it into a steel coil warehouse along with a transport chain; after a specified period of insulating time, removing the coil from the insulating enclosure, and cooling it to room temperature in air, wherein the
(Continued)

coiling is performed at a temperature of 400-600° C.; said covering on-line with an insulating enclosure means each hot-rolled coil is individually covered with an independent, closed insulating enclosure unit within 60 minutes after unloading; the insulating time of the steel coil in the insulating enclosure is ≥60 minutes. The inventive method replaces the intermediate annealing step in the production process of cold-rolled Q & P steel. The inventive method has low cost and high efficiency, and it is not affected by the surrounding environment.

8 Claims, 2 Drawing Sheets

(56) References Cited

FOREIGN PATENT DOCUMENTS

| | | | | | |
|---|---|---|---|---|---|
| CN | 102226248 | A | | 10/2011 | |
| CN | 203064459 | U | | 7/2013 | |
| CN | 103233161 | | | 8/2013 | |
| CN | 103757196 | | | 4/2014 | |
| CN | 104988391 | A | | 10/2015 | |
| CN | 105478472 | | | 4/2016 | |
| CN | 105734213 | A | * | 7/2016 | ..... C21D 1/19 |
| CN | 105734213 | A | | 7/2016 | |
| CN | 206447906 | U | | 8/2017 | |
| JP | S61159534 | A | | 7/1986 | |
| JP | 2001071019 | A | | 3/2001 | |
| JP | 2001071019 | A | * | 3/2001 | |
| JP | 2010090475 | A | | 4/2010 | |
| JP | 2013060657 | A | | 4/2013 | |
| JP | 2015175004 | A | | 10/2015 | |
| JP | 2016130334 | A | | 7/2016 | |
| JP | 2016141848 | A | | 8/2016 | |
| WO | 2016095664 | | | 6/2016 | |

OTHER PUBLICATIONS

Office Action dated Apr. 6, 2021 for Japanese Patent Application No. 2020537824.

European Search Report dated May 20, 2020 in co-pending EP Application No. EP 18 85 7665.

G.A. Thomas et al., "Quenched and Partitioned Microstructures Produced via Gleeble Simulations of Hot-Strip Mill Cooling Practices", Metallurgical and Mats. Trans. A, Springer-Verlag, New York, vol. 42, No. 12, Mar. 9, 2011, pp. 3652-3659.

Yunbo Xu et al., "Microstructure Evolution and Mechanical Properties of a Hot-Rolled Directly Quenched and Partitioned Steel Containing Proeutectoid Ferrite", Mats. Sci. and Eng., A, vol. 607, Apr. 13, 2014, pp. 460-475.

De Cooman et al., "Quench and Partitioned Steel: A New AHSS Concept for Automotive Anti-Intrusion Applications," Steel Res. Int'l., vol. 77, No. 9-10, Sep. 1, 2006, pp. 634-640.

International Search Report and Written Opinion dated Nov. 28, 2018 for PCT Patent Application No. PCT/CN2018/106703.

* cited by examiner

SOFTENING METHOD FOR HIGH-STRENGTH Q AND P STEEL HOT ROLL

CROSS-REFERENCE TO RELATED APPLICATIONS

This application is a 371 U.S. National Phase of PCT International Application No. PCT/CN2018/106703 filed on Sep. 20, 2018, which claims benefit and priority to Chinese patent application no. 201710853613.3 filed on Sep. 20, 2017, and 201810631922.0 filed on Jun. 19, 2018, respectively. Each of the above-referenced applications is incorporated by reference herein in its entirety.

TECHNICAL FIELD

The present disclosure pertains to the technical field of the third-generation advanced high-strength automotive steel production, and particularly relates to a softening method for high-strength Q & P steel hot-rolled coils.

BACKGROUND ART

With the increasing requirements for light weight and collision safety in the automotive industry, the proportion of advanced high-strength steel used in bodies in white is increasing. Automotive steel is classified according to the indices of comprehensive mechanical performances—product of strength and elongation $U_T$ (tensile strength×elongation):

The first-generation high-strength steel has a $U_T$ of 15±10 GPa %, as well as low indices of light weight and safety;

The second-generation high-strength steel has a $U_T$ of 60±10 GPa %, indicating both ideal strength and plasticity, but it involves a complex process, a high alloy content, and a production cost that remains high, leading to low market acceptance; and The third-generation high-strength steel has a $U_T$ of 30±10 GPa %, with indices of light weight and safety higher than the first-generation high-strength steel, while its production cost is significantly lower than the second-generation high-strength steel, making it widely attractive in the automotive and alloy industries.

In recent years, Q & P (Quenching and Partitioning) steel exploiting C, Si, Mn and other inexpensive elements as the main alloying elements has been accepted as an important representative of the third-generation advanced high-strength automotive steel.

Its industrial production processes are grouped into two categories:

One category of processes provides hot-rolled Q & P steels such as those disclosed by Chinese Patent Application Nos. CN105177415A, CN105441814A, CN103215516A, CN103805851A, CN104532126A, CN103233161A, CN103805869A, CN102226248A, etc, which are produced by smelting and hot rolling. These processes are characterized by short process flows and low production costs, but very high requirements are imposed on the control of laminar cooling after hot rolling. These requirements are difficult to achieve in the industry, and the product surface quality is difficult to guarantee.

The other category of processes provides cold-rolled Q & P steels, such as those disclosed by Chinese Patent Application Nos. CN105734213A, CN104988391A, CN105648317A, etc, which are produced by smelting, hot rolling, intermediate annealing, cold rolling, and final Q & P heat treatment. They are characterized by the high strength, high strain hardening rate, good plasticity, and good surface quality of the products, but the process flows are long, and the production costs are relatively high. Compared with the production process flow of ordinary cold-rolled products, cold-rolled Q & P steel requires an additional intermediate annealing step (bell furnace annealing or continuous annealing) between hot rolling and cold rolling. That is, a hot-rolled coil is reheated to an austenitizing temperature which is held for a sufficient period of time, and then cooled to room temperature at a suitable rate, so as to soften the Q & P steel hot-rolled coil and thereby reduce the rolling force of the cold rolling unit to fulfil the purpose of cold rolling.

SUMMARY

An object of the present disclosure is to provide a new, low-cost, high-efficiency softening method for a high-strength Q & P steel hot-rolled coil, and use self-tempering softening in place of an intermediate annealing step in a production process for cold-rolled Q & P steel.

To achieve the above object, the technical solution of the present disclosure is as follows:

According to the present disclosure, after Q & P steel is hot rolled, quenched and coiled, the resulting steel coil is quickly covered on-line with an independent, closed insulating enclosure unit to perform controlled cooling of the steel coil and use residual heat from the coiling to perform effective self-tempering softening treatment, thereby adjusting the microstructure of the Q & P steel hot-rolled coil on-line to decompose martensite and thus fulfil the purpose of reducing the strength of the steel coil.

In particular, the present disclosure provides a softening method for a high-strength Q & P steel hot-rolled coil, characterized in: after heating a Q & P steel ingot, subjecting it to rough rolling, finish rolling, laminar cooling and coiling to obtain a hot-rolled coil; after unloading the coil, covering the coil on-line with an insulating enclosure and moving it into a steel coil warehouse along with a transport chain; after a specified period of insulating time, removing the coil from the insulating enclosure, and cooling it to room temperature in air, wherein the coiling is performed at a temperature of 400-600° C.; said covering on-line with an insulating enclosure means each hot-rolled coil is individually covered with an independent, closed insulating enclosure unit within 60 minutes after unloading; the insulating time of the steel coil in the insulating enclosure is ≥60 minutes.

Further, the ingot is heated at a temperature of ≥1150° C., and a soaking time is ≥60 minutes.

Preferably, the ingot is heated at a temperature of 1200-1300° C., and the soaking time is 1-3 hours.

Further, the rough rolling and finish rolling are performed in a temperature zone for complete austenization, an overall hot rolling reduction rate is ≥90%, and a final rolling temperature is 800-1000° C.

Preferably, each hot-rolled coil is individually covered with an insulating enclosure within 20 minutes after it is unloaded.

Further, the steel coil is cooled at a cooling rate of ≤15° C./hour in the insulating enclosure.

Preferably, the insulating time of the steel coil in the insulating enclosure is 1-24 hours.

Further, an exemplary insulating enclosure is the on-line insulating and retarded cooling device on a steel strip production line in any embodiment disclosed by CN 107470377 A, the content of which is incorporated herein in its entirety by reference.

In the manufacture method of the present disclosure:

if the temperature for heating the ingot is lower than 1200° C., it will be undesirable for homogenization of the alloy elements; if the temperature is higher than 1300° C., not only the manufacture cost will be increased, but also the quality of heating will be somewhat degraded. Therefore, it's desirable to control the temperature for heating the ingot at 1200-1300° C.

Similarly, the soaking time also needs to be controlled in a certain range. The soaking time refers to a period of time during which the ingot is held at a specified heating temperature to which the ingot is heated. If the soaking time is too short, solute atoms such as Si, Mn and the like cannot diffuse sufficiently, and thus the heating quality of the ingot cannot be guaranteed; but if the soaking time is too long, austenite grains will become coarse, and the manufacturing cost will be increased. Therefore, it is generally appropriate to control the soaking time at 1-3 hours. For higher heating temperatures, the soaking time may be shortened accordingly in an appropriate way.

In the composition of Q & P steel, the main alloying elements include C, Si, Mn. The C content is generally greater than 0.15%, the Si content is generally greater than 1.0%, and the Mn content is generally greater than 1.5%. As a result, after the ingot is heated, these alloying elements are solid-dissolved in austenite, not only improving the stability of austenite, but also increasing its high-temperature strength. Therefore, rough rolling and finish rolling should be performed in a temperature zone that allows for complete austenization in order to reduce hot rolling force and ensure steady strip running.

Although oxide scales formed during the heating process are generally removed completely by means of high-pressure descaling before hot rolling, a layer of oxide scales may also be formed on the strip steel surface during the rolling process and the subsequent cooling process. In order to reduce the oxide scales and avoid or alleviate the problem of internal oxidation, the designed coiling temperature should not exceed 600° C. The lower the coiling temperature, the thinner the oxide scale layer. However, as the coiling temperature decreases, the martensite-austenite structure and the martensite content in the Q & P steel hot-rolled coil will gradually increase, which will lead to a significant increase in strength, unfavorable for steady coiling and cold rolling in a subsequent step. Therefore, the designed coiling temperature should not be lower than 400° C.

After coiling, the Q & P steel hot-rolled coil has a microstructure mainly consisting of bainite and martensite, wherein the volume percentage of martensite is ≥20%, and the tensile strength exceeds 1000 MPa. In order to improve the manufacturability of cold rolling in the subsequent step and reduce the cold rolling force, it is necessary to soften the Q & P steel hot-rolled coil. In the present disclosure, after the Q & P steel hot-rolled coil is unloaded, it's quickly covered on-line (preferably within 20 minutes) with an independent, closed insulating enclosure unit, so as to cool the steel coil in a controlled way, and exploit the residual heat from the coiling for self-tempering treatment. During the retarded cooling in the insulating enclosure, martensite decomposes gradually, and transforms into cementite and a small amount of ferrite, such that the strength of the steel coil is decreased. The term "on-line" means that a steel coil should be covered with an insulating enclosure as soon as it is unloaded. Compared with an "off-line" mode where a steel coil is moved into a warehouse and then covered with an insulating enclosure: (i) the "on-line" mode ensures the temperature at which the steel coil enters the enclosure and the residual heat from the coiling can be fully utilized for self-tempering treatment; (ii) in the "off-line" mode, during the transportation of the steel coil before entering the insulating enclosure, the temperature drop at the inner circle, outer circle and sides is significantly greater than that at the middle, and thus the overall temperature uniformity of the steel coil is poor; (iii) in the "off-line" mode, the phase transformation uniformity in the steel coil is poor, and the volume fraction of martensite is too high in local areas, which is unfavorable for uniform tempering and softening.

The beneficial effects of the present disclosure include:

(1) By designing a reasonable rolling process in conjunction with an innovative "single coil" insulating and slow cooling process following hot rolling and coiling, the present disclosure enables controlled cooling of a Q & P steel hot-rolled coil on-line with high efficiency at low cost, and adjustment of its microstructure.

(2) Compared with the conventional process of slow cooling in stack, the Q & P steel hot-rolled coil manufactured according to the present disclosure has a yield strength reduction of ≥85 MPa and a tensile strength reduction of ≥150 MPa, while having a good elongation (≥15%). The softening effect is remarkable. The intermediate annealing step in the traditional process may be replaced, and the production cost of cold-rolled Q & P steel may be reduced.

DETAILED DESCRIPTION

The disclosure will be further illustrated with reference to the following Examples and accompanying drawings.

Table 1 shows the key process parameters of the Examples in the present disclosure, Table 2 shows the key process parameters of the Comparative Examples in the present disclosure, and Table 3 shows the properties of the steel coils of the Examples and the Comparative Examples in the present disclosure.

The process flow for the Examples in the present disclosure is as follows: heating a Q & P steel ingot→rough rolling→finish rolling→laminar cooling→coiling→covering with an insulating enclosure on-line→removing from the insulating enclosure, wherein the key process parameters are shown in Table 1.

The process flow for the Comparative Examples in the present disclosure is as follows: heating a Q & P steel ingot→rough rolling→finish rolling→laminar cooling→coiling→slow cooling the steel coil in stack, wherein the key process parameters are shown in Table 2.

TABLE 1

| Ex. | Steel coil thickness (mm) | Heating temperature (° C.) | Rough rolling temperature (° C.) | Final rolling temperature (° C.) | Coiling Temperature (° C.) | Covering time (min) | Insulating time (h) |
|---|---|---|---|---|---|---|---|
| 1 | 3.0 | 1261 | 1128 | 927 | 523 | 9 | 2 |
| 2 | 3.0 | 1265 | 1122 | 930 | 510 | 28 | 4 |
| 3 | 3.0 | 1259 | 1127 | 933 | 520 | 10 | 2 |
| 4 | 2.6 | 1267 | 1130 | 938 | 498 | 10 | 4 |
| 5 | 2.6 | 1263 | 1125 | 936 | 488 | 8 | 8 |

TABLE 2

| Comp. Ex. | Steel coil thickness (mm) | Heating temperature (° C.) | Rough rolling temperature (° C.) | Final rolling temperature (° C.) | Coiling Temperature (° C.) |
|---|---|---|---|---|---|
| 1 | 3.0 | 1268 | 1129 | 920 | 522 |
| 2 | 3.0 | 1266 | 1130 | 925 | 530 |
| 3 | 3.0 | 1259 | 1125 | 935 | 529 |
| 4 | 2.6 | 1268 | 1125 | 937 | 481 |
| 5 | 2.6 | 1269 | 1129 | 936 | 486 |

TABLE 3

| | Yield strength (MPa) | Tensile strength (MPa) | Elongation/% |
|---|---|---|---|
| Ex. | | | |
| 1 | 644 | 816 | 20 |
| 2 | 692 | 840 | 16 |
| 3 | 726 | 859 | 18 |
| 4 | 849 | 970 | 17 |
| 5 | 885 | 1056 | 16 |
| Comp. Ex. | | | |
| 1 | 740 | 966 | 16 |
| 2 | 928 | 1063 | 14 |
| 3 | 1021 | 1184 | 14 |
| 4 | 1024 | 1257 | 15 |
| 5 | 970 | 1296 | 14 |

As can be seen from the data of the Examples and Comparative Examples in Table 3, in comparison with the method employing slow cooling of steel coils in stack, the Q & P steel hot-rolled coils produced by the method proposed by the present disclosure have a yield strength reduction of ≥85 MPa, a tensile strength reduction of ≥150 MPa, and an increase in elongation at break of ≥2%, indicating that the method proposed by the present disclosure can effectively soften Q & P steel hot-rolled coils, and improve the plasticity index of the material at the same time, which is beneficial to reduce the cold rolling force in the subsequent step.

Figure 1:
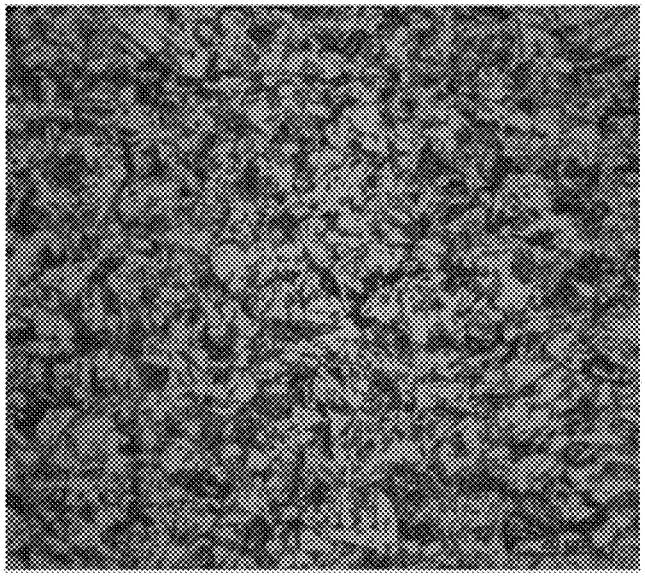
FIG. 1 is a typical metallographical photo of the test steel of Example 1 in the present disclosure.
Figure 2:
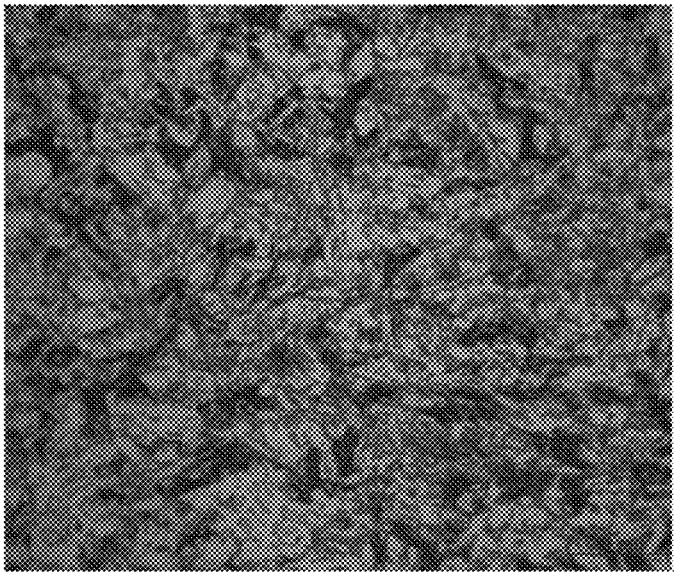
FIG. 2 is a typical metallographical photo of the test steel of Example 2 in the present disclosure.

FIGS. 1 and 2 show the typical metallographical photos of the test steel of Examples 1 and 2. As can be seen clearly from the photos, without the treatment using the insulating enclosure, the microstructure of the steel coils is mainly bainite+martensite.

Figure 3:
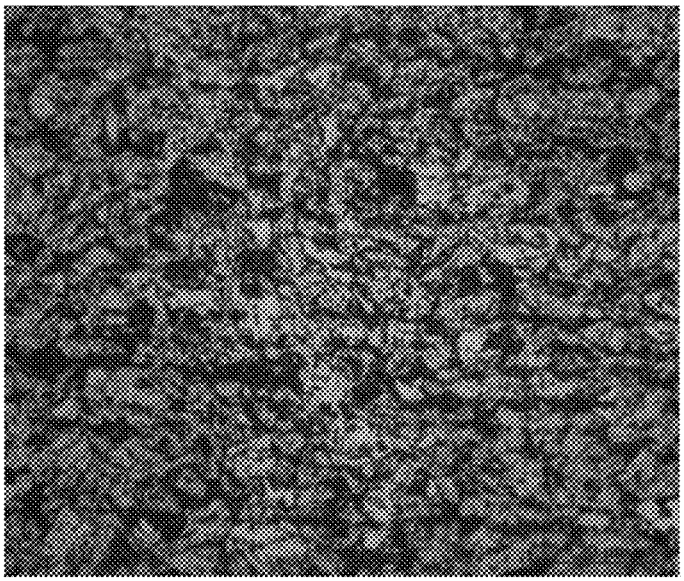
FIG. 3 is a typical metallographical photo of the test steel of Example 1 in the present disclosure.
Figure 4:
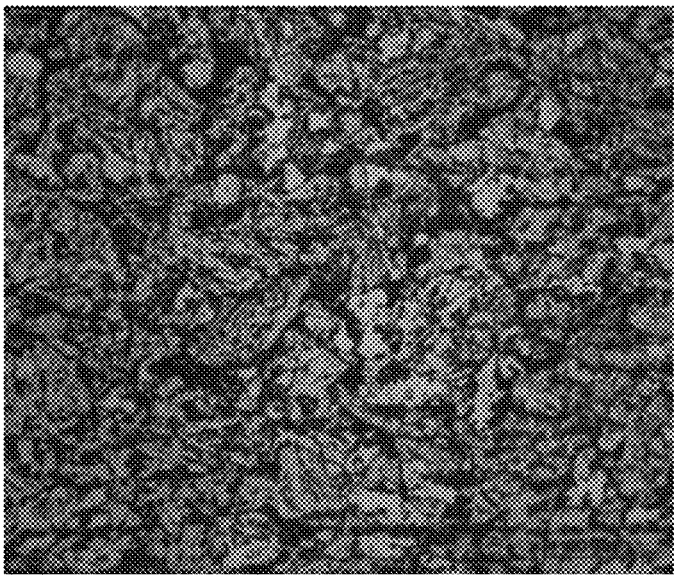
FIG. 4 is a typical metallographical photo of the test steel of Example 2 in the present disclosure.

FIGS. 3 and 4 show the typical metallographical photos of the test steel of Examples 1 and 2. As can be seen clearly from the photos, with the treatment using the insulating enclosure, the microstructure of the steel coils is mainly bainite+cementite.

The embodiments of the present disclosure are not limited to the foregoing examples. Any other changes, modifications, substitutions, combinations, and simplifications that do not depart from the spirit and principle of the present disclosure should all be equivalent alternatives, all falling in the protection scope of the present disclosure.

What is claimed is:

1. A softening method for a high-strength Q & P steel hot-rolled coil, characterized in:

after heating a Q & P steel ingot, subjecting it to rough rolling, finish rolling, laminar cooling and coiling to obtain a hot-rolled coil;

after unloading the hot-rolled coil, covering the hot-rolled coil individually with an independent, closed insulating enclosure unit within 60 minutes and moving it into a steel coil warehouse along with a transport chain;

after an insulating time of 60 minutes, removing the hot-rolled coil from the insulating enclosure unit, and cooling it to room temperature in air, wherein the coiling is performed at a temperature of 400-600° C., wherein the Q & P steel hot-rolled coil has a yield strength reduction of ≥85 MPa and a tensile strength reduction of ≥150 MPa, while having an elongation of ≥15% in comparison with a method employing a slow cooling of steel coils in stack; and after treatment with the insulating enclosure unit, the microstructure of the steel coil is mainly bainite+cementite.

2. The softening method for a high-strength Q & P steel hot-rolled coil according to claim 1, characterized in that the ingot is heated at a temperature of ≥1150° C., and a soaking time is 60 minutes.

3. The softening method for a high-strength Q & P steel hot-rolled coil according to claim 1, characterized in that the ingot is heated at a temperature of 1200-1300° C., and the soaking time is 1-3 hours.

4. The softening method for a high-strength Q & P steel hot-rolled coil according to claim 1, characterized in that the rough rolling and finish rolling are performed in a temperature zone for complete austenization, an overall hot rolling reduction rate is ≥90%, and a final rolling temperature is 800-1000° C.

5. The softening method for a high-strength Q & P steel hot-rolled coil according to claim 1, characterized in that each hot-rolled coil is individually covered with an insulating enclosure within 20 minutes after it is unloaded.

6. The softening method for a high-strength Q & P steel hot-rolled coil according to claim 1, characterized in that the steel coil is cooled at a cooling rate of ≤15° C./hour in the insulating enclosure.

7. The softening method for a high-strength Q & P steel hot-rolled coil according to claim 1, characterized in that the insulating time of the steel coil in the insulating enclosure is 1-24 hours.

8. The softening method for a high-strength Q & P steel hot-rolled coil according to claim 1, characterized in that the coiling is performed at a temperature of 400-523° C.

* * * * *